US005437132A

United States Patent [19]

Meyers

[11] Patent Number: 5,437,132

[45] Date of Patent: Aug. 1, 1995

[54] ROOF AND WALL PANEL TIEDOWN BRACKET AND METHOD

[76] Inventor: Robert D. Meyers, 6100 Palmer Blvd., Sarasota, Fla. 34232

[21] Appl. No.: 150,836

[22] Filed: Nov. 12, 1993

[51] Int. Cl.[6] ..... E04B 5/00

[52] U.S. Cl. ..... 52/410; 52/489.1; 52/715

[58] Field of Search ..... 52/715, 713, 712, 410, 52/91.3, 296, 506.05, 489.1, 489.2; 403/232.1

[56] References Cited

U.S. PATENT DOCUMENTS

| | | | |
|---|---|---|---|
| 3,144,733 | 8/1964 | Balinski | 52/715 X |
| 3,500,604 | 3/1970 | Vandall | 52/715 X |
| 3,910,001 | 10/1975 | Jackson | 52/712 X |
| 4,498,801 | 2/1985 | Gilb | 52/715 X |
| 4,517,776 | 5/1985 | Barker . | |
| 4,544,595 | 10/1985 | Tomason . | |
| 4,796,403 | 1/1989 | Fulton et al. . | |
| 4,893,961 | 1/1990 | O'Sullivan et al. | 52/715 X |
| 4,946,123 | 8/1990 | Albert . | |
| 4,995,206 | 2/1991 | Colonias et al. | 52/715 X |
| 5,109,646 | 5/1992 | Colonias et al. . | |

*Primary Examiner*—Lanna Mai
*Attorney, Agent, or Firm*—Charles J. Prescott

[57] ABSTRACT

A roof and wall panel tiedown bracket and method of securing roof and wall panels with one surface of the panels positioned against a supporting rafter and wall stud, respectively. The tiedown bracket is preferably made from a single folded sheet metal pattern and includes an elongated main body having first and second flat generally coextensive panels connected edge to edge orthogonally one to another. The first plate is sized in length equal to a width of a rafter or wall stud. One end of the second plate extends beyond that of the first plate a distance equal to a thickness of the roof or wall panels and continues therefrom to define two flat securing plates which extend orthogonally in either direction from the second plate. When the bracket is properly positioned, the securing plates are attached as by nailing against the other surface of the panels and the first plate is connected as by nailing to one side of the rafter or wall stud. The first plate may also extend around the other edge of the rafter or wall stud to the opposite side thereof for adding strength to the attachment.

5 Claims, 2 Drawing Sheets

ROOF AND WALL PANEL TIEDOWN BRACKET AND METHOD

BACKGROUND OF THE INVENTION

1. Scope of Invention

This invention relates generally to building wall and roof construction, and more particularly to a roof and wall panel tiedown bracket for securing plywood roof and wall panels to their wood supporting rafters and wall studs, respectively.

2. Prior Art

In wood framed building construction such as in residential homes, it is common practice to attach roof and wall panels directly against their supporting wood rafters and wood studs, respectively, by simply nailing through the panels directly into the rafters and studs. Where no significant loading occurs from the inside of the building, but only occurs against these exterior roof and wall surfaces as by snow loading or moderate wind loading, such nailing procedures are satisfactory. However, in more sever weather conditions such as in tornados and hurricanes, unusual pressure gradients and wind loading are significantly increased in a manner which tends to lift or rip these exterior panels from their support rafters and wall studs.

This serious limitation of conventional building construction has been highlighted by the devastating effect of a very recent hurricane, Andrew, which virtually destroyed an entire population in South Florida, in part because of this as one of many construction deficiencies.

Various modifying metal bracketry and fasteners have been developed which add to the strength and versatility of this basic wooden frame construction. One such device is disclosed in U.S. Pat. No. 4,517,776 invented by Barker which is directed to a counter baton-rafter connecting bracket for retaining a layer of thermal insulation over the roof rafters.

In U.S. Pat. No. 5,109,646, Colonnias discloses a bearing connection for distributing downward gravity bearing loads via sheet metal connectors into a wooden structural member such as a floor or joist. This invention is also intended to resist seismic, hurricane or other upward forces but does not act directly to retain the roofing and wall panels themselves, but rather only on rafters and joists.

Tomason, in U.S. Pat. No. 4,544,595, discloses a prefabricated roofing and siding panel which includes a fastener means and bracketry for securing these pre-fabricated panels to the roof rafters themselves. However, this invention is only useful in conjunction with the specific structure of the prefabricated panels disclosed and is not universally applicable.

A roof bracket is disclosed in U.S. Pat. No. 4,946,123 invented by Albert which discloses a roofing bracket connectable to a roof truss for temporarily supporting a roofer working on a sloping roof. An articulating roofing panel clip has been invented by Fulton and disclosed in U.S. Pat. No. 4,796,403 designed to secure a standing seam roofing panel to purlins or joists. This invention is likewise not universally applicable but rather is only designed to act in conjunction with uniquely configured metal roofing panels disclosed.

The present invention provides for a means for positively securing roof panels and wall panels to their supporting rafters and wall studs, respectively, which resists upward and outward air pressure from detaching the roof and wall panels during severe weather and seismic activity, adding significant attachment strength over conventional nailing.

BRIEF SUMMARY OF THE INVENTION

This invention is directed to a roof and wall panel tiedown bracket and method of securing roof and wall panels wherein one surface of the panels positioned against a supporting rafter and wall stud, respectively. The tiedown bracket is preferably made from a single folded sheet metal pattern and includes an elongated main body having first and second flat generally coextensive plates connected edge to edge orthogonally one to another. The first plate is sized in length equal to a width of a rafter or wall stud. One end of the second plate extends beyond that of the first plate a distance equal to a thickness of the roof or wall panels and continues therefrom to define two flat securing plates which extend orthogonally in either direction from the second plate. When the bracket is properly positioned, the securing plates are attached as by nailing against the other surface of the panels and the first plate is connected as by nailing to one side of the rafter or wall stud. The first plate may also extend around the other edge of the rafter or wall stud to the opposite side thereof for adding strength to the attachment.

It is therefore an object of this invention to provide a roof and wall panel tiedown bracket for positively connecting roof and wall panels to their respective supporting rafters and wall studs.

It is yet another object of this invention to provide a tiedown bracket for significantly enhancing over conventional nailing the resistivity to upward and outward detachment of roof and wall panels from their support rafters and wall studs as during violent wind storms and seismic activity.

It is yet another object of this invention to provide an economical and easily manufacturable sheet metal tiedown bracket which significantly increases the strength of attachment of roof panels and wall panels to their respective supporting roof rafters and wall studs over conventional nailing attachment.

In accordance with these and other objects which will become apparent hereinafter, the instant invention will now be described with reference to the accompanying drawings.

DETAILED DESCRIPTION OF THE INVENTION

Figure 1:
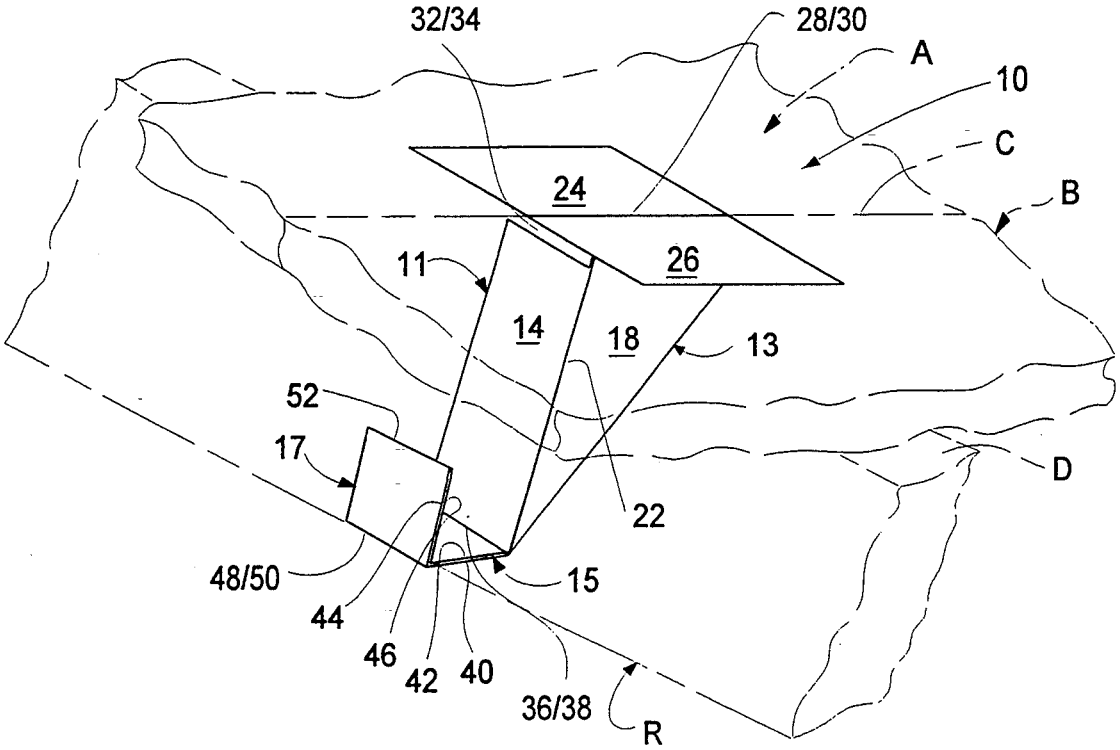
FIG. 1 is a perspective view of the invention showing a portion of two abutting roof panels supported top a conventional rafter shown in phantom.

Referring now to the drawings, and particularly to FIGS. 1, 2 and 4 to 6, the preferred embodiment of the invention is shown generally at numeral 10. This tiedown bracket 10 is formed of folded sheet metal material, the specific pattern being described in conjunction with FIG. 2 described herebelow.

The tiedown bracket 10 includes an elongated main body formed of a first and second flat plates 11 and 13, respectively. These plates 11 and 13 are generally coextensive and orthogonal to one another, being connected along a common edge margin 22 therebetween.

The length of plate 11 is equal to a width of a side F of conventional rafter R or wall stud (not shown) and is positioned directly against the surface f of the rafter R.

Plate 13 extends lengthwise beyond the end of plate 11 a distance equal to the thickness of plywood roofing panels A and El or wall panels (not shown). In constructing a roof or wall, the supporting rafters R and wall studs (not shown) are significantly longer than the width of each of these panels A and B. Thus, a plurality of roofing panels A and B are required to completely cover and form the continuous roof and wall surface. Typically then, the roof panels A and B are positioned and supported on edge surface D and abutted against one another along a joint line C and nailed directly therethrough into the supporting rafter R or wall stud (not shown).

Figure 5:
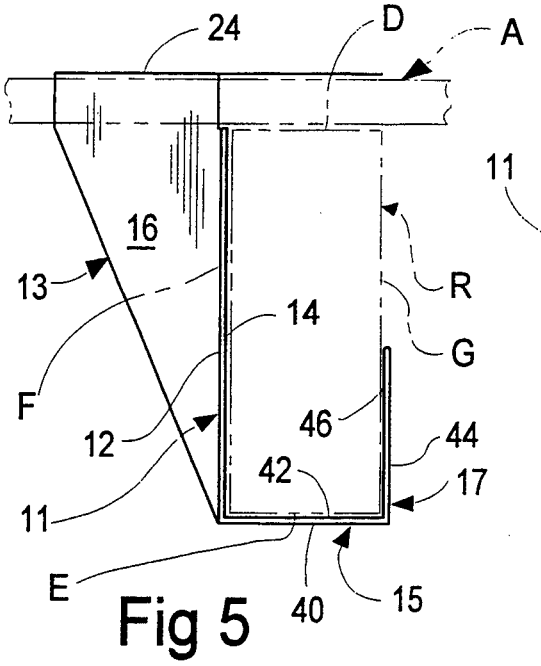
FIG. 5 is a front elevation view of the invention in the direction of arrows 5—5 in FIG. 4.
Figure 6:
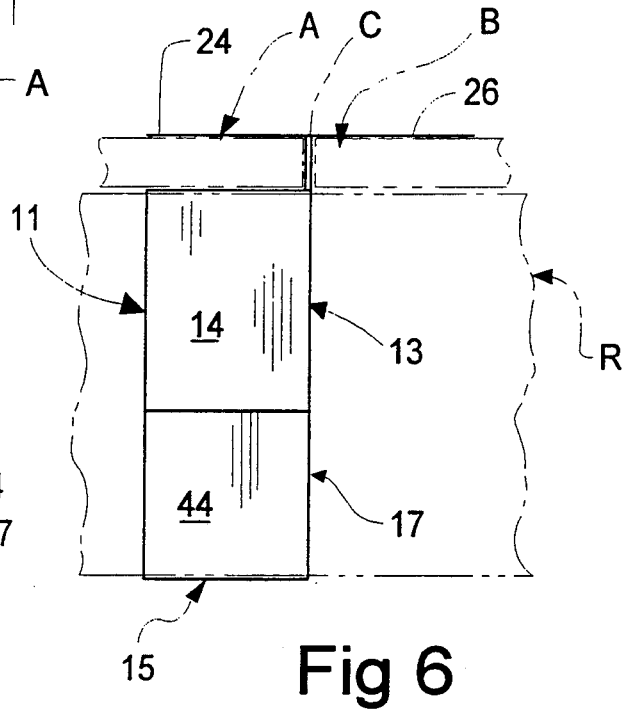
FIG. 6 is a side elevation view of the invention in the direction of arrows 6—6 in FIG. 4.

As best seen in FIGS. 1, 5 and 6, the plate 13 thus extends a distance equal to the thickness of the roof panels A and B, flat securing plates 24 and 26 then extending orthogonally in either direction therefrom. These securing plates 24 and 26 bear directly against the outer or exposed surface of the roofing panels A and B and are secured thereagainst as by nailing attachment.

Figure 2:
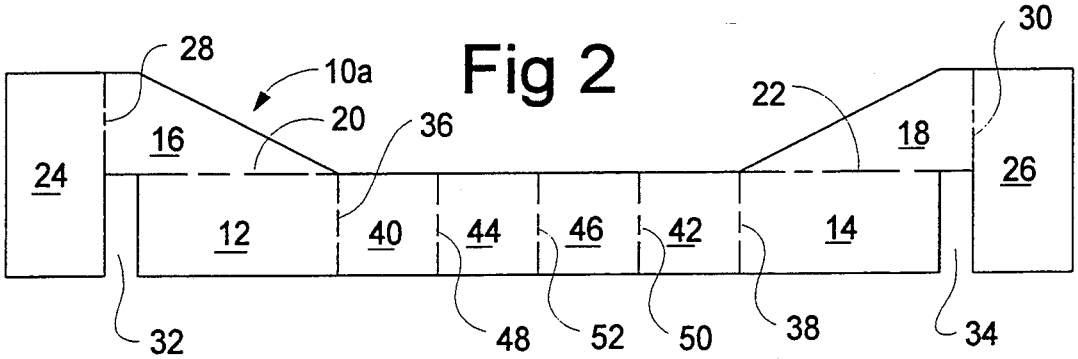
FIG. 2 is a top plan view of the preferred embodiment of a sheet metal pattern for fabricating the roof and wall panel tiedown bracket shown in FIG. 1.

Turning additionally to FIG. 2, the sheet metal pattern in-the-flat for fabricating the tiedown bracket 10 shown in FIG. 1 is generally shown at numeral 10*a*. To form the tiedown bracket 10 of FIG. 1, the pattern 10*a* is folded about fold line 52 so that flat sheet metal 44/46, 40/42, 12/14, 16/18 and 24/26 are positioned against one another. Thereafter, orthogonal folds or bends are made about fold lines 40/50, 36/38, and 20/22. Opposite orthogonal folds are made about fold lines 28 and 30 so as to define securing plates 24 and 26 which extend in opposite directions from one another in coplanar fashion as previously described. Obviously the specific order and sequence of these folds may be varied depending upon adaptation to a particular manufacturing process. Additionally, the mating sections 44/46, 40/42, 12/14, and 16/18 or any combination thereof, may be fastened together upon manufacturing as by spot welding for added strength and to prevent separation.

Sections 44/46 and 40/42 which define plates 15 and 17, respectively, orthogonally extend as best seen in FIG. 1 from plate 11 and serve to provide additional securing strength and nailing surface for interconnection to and around edge surface E and side surface G of rafter R. Rectangular notches 32 and 34 are provided in pattern 10*a* to facilitate installation of the bracket 10, having a width equal to the thickness of each of the plywood roof panels A and B.

Figure 3:
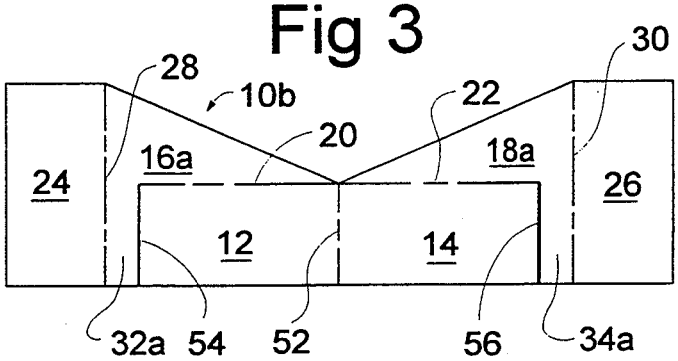
FIG. 3 is a top plan view of another embodiment of a sheet metal tiedown bracket pattern.
Figure 4:
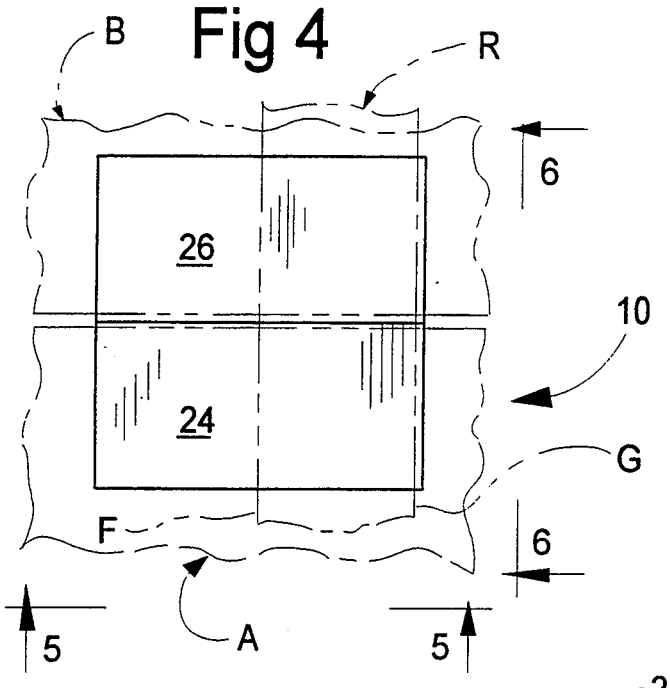
FIG. 4 is a top plan view of the tiedown bracket shown in FIG. 1.

Referring lastly to FIG. 3, an alternate embodiment of the pattern of the invention is shown generally at 10*b*. This pattern 10*b* includes rectangular sections 12 and 14 to be folded against one another about fold line 52 as previously described to define plate 11. Triangular panels 16*a* and 18*a* also folded together about fold lines 20 and 22, extending orthogonally from sections 12 and 14 to define plate 13. In this embodiment, rectangular sections 32*a* and 32*b* remain, rather than being defined by fold notched out lines 28 and 30 and cut lines 54 and 56. Securing plates 24 and 26 extend orthogonally in either direction about fold lines 28 and 30 from triangular panels 16*a* and 18*a* as previously described.

In this pattern embodiment 10*b* of FIG. 3, referring back to FIG. 1, plates 15 and 17 are thus eliminated for economy of manufacture and installation so that only main plate 11 is attachable as by nailing against the side F of rafter R.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A roof and wall panel tiedown bracket for connecting two roof or wall panels abutted together edge to edge along a common joint line therebetween against an edge surface of a supporting rafter or wall stud, respectively, the joint line being orthogonal to a length of the rafter or wall stud, comprising:

an elongated main body formed of first and second flat plates connected orthogonally one to another along a longitudinal margin therebetween;

said first plate having a length generally equal to, and being positionable for nailing attachment against, a width of one side of the rafter or wall stud;

one end of said second plate extending beyond an adjacent end of said first plate a distance equal to a thickness of the roof or wall panel;

two flat securing plates extending orthogonally in either direction from one end of said second plate, said securing plates also being orthogonal to said first plate;

each said securing plate being positioned for nailing attachment against a surface of each roof or wall panel adjacent the joint line when said first plate is positioned for nailing attachment against one side of the rafter or wall stud, respectively.

2. A roof and wall panel tiedown bracket as set forth in claim 1, further comprising:

a third flat plate extending orthogonally from a second end of said first plate in a direction opposite from said second plate;

a fourth flat plate extending orthogonally from said third plate parallel and opposing spaced from said first plate;

said third and fourth plates being positioned against another edge surface and the other side, respectively, of the rafter or wall stud when said first plate is positioned for nailing attachment against one side of the rafter or wall stud, respectively.

3. A roof and wall panel tiedown bracket for connecting two roof or wall panels abutted together edge to edge along a common joint line therebetween and supported by having one surface of each roof or wall panel against an edge surface of a rafter or wall stud, respectively, the joint line being orthogonal to a length of the rafter or wall stud, said tiedown bracket formed of a single folded sheet metal pattern, said tiedown bracket comprising:

an elongated main body formed of first and second flat generally coextensive plates connected edge to edge orthogonally one to another along a common margin therebetween;

said first plate being rectangular and formed of two identically sized sheet metal portions folded against one another having a length generally equal to, and being positionable for nailing attachment against, a width of one side of the rafter or wall stud;

said second plate being generally triangular and formed of two identically sized sheet metal portions folded against one another, one end of said second plate extending beyond an adjacent end of said first plate a distance equal to a thickness of the roof or wall panel;

two flat coplanar securing plates dependingly extending orthogonally in either direction from one end of said second plate, said securing plates also being orthogonal to said first plate;

each said securing plate generally rectangular and formed of a single sheet metal portion being positioned for nailing attachment against another surface of each roof or wall panel and adjacent the joint line when said first plate is positioned for nailing attachment against one side of the rafter or wall stud, respectively.

4. A roof and wall panel tiedown bracket as set forth in claim 3, further comprising: a third flat plate extending orthogonally from a second end of said first plate in a direction opposite from said second plate;

a fourth flat plate extending orthogonally from said third plate parallel and opposing spaced from said first plate;

said third and fourth plates being positioned against another edge surface and the other side, respectively, of the rafter or wall stud when said first plate is positioned for nailing attachment against one side of the rafter or wall stud, respectively.

5. A method of securing two roof or wall panels supported against an edge surface of a rafter or wall stud, respectively, said roof and wall panels being abutted together edge to edge along a common joint line therebetween, said joint line being orthogonal to a length of said rafter or wall stud, said method comprising the steps of:

A. positioning a roof and wall panel tiedown bracket within said joint line and against one side of said rafter or wall stud; said tiedown bracket comprising:

an elongated main body formed of first and second flat plates connected orthogonally one to another along a longitudinal margin therebetween;

said first plate having a length generally equal to, and being positionable for nailing attachment against, a width of one side of the rafter or wall stud;

one end of said second plate extending beyond an adjacent end of said first plate a distance equal to a thickness of the roof or wall panel;

two flat securing plates extending orthogonally in either direction from said one end of said plate, said securing plates also being orthogonal to said first plate;

each said securing plate being positioned for nailing attachment against a surface of each roof or wall panel adjacent the joint line when said first plate is positioned for nailing attachment against one side of the rafter or wall stud, respectively;

B. nailing said first plate to said rafter or wall stud;

C. nailing each said securing plate to each corresponding said roof or wall panel, respectively.

* * * * *